US005954280A

United States Patent [19]

Kroger et al.

[11] Patent Number: 5,954,280

[45] Date of Patent: Sep. 21, 1999

[54] TOP BLOCKER FOR A PAPER SHREDDER

[75] Inventors: Bruce R. Kroger, West Chicago; Leonard A. Koniewicz, Lockport, both of Ill.

[73] Assignee: Fellowes Manufacturing Company

[21] Appl. No.: 09/076,614

[22] Filed: May 12, 1998

[51] Int. Cl.[6] ..... B02C 18/16

[52] U.S. Cl. ..... 241/166; 241/236

[58] Field of Search ..... 241/166, 167, 241/236

[56] References Cited

U.S. PATENT DOCUMENTS

| | | | |
|---|---|---|---|
| 1,178,386 | 4/1916 | Edwards . | |
| 2,554,114 | 5/1951 | Menkin et al. | 164/60 |
| 2,770,302 | 11/1956 | Lee | 164/60 |
| 3,033,064 | 5/1962 | Lee . | |
| 3,286,574 | 11/1966 | Durand | 83/167 |
| 3,724,766 | 4/1973 | Bosland | 241/100 |
| 3,797,765 | 3/1974 | Samuels | 241/236 |
| 3,921,920 | 11/1975 | Brocard | 241/159 |
| 4,018,392 | 4/1977 | Wagner | 241/167 |
| 4,257,565 | 3/1981 | Hatanaka | 241/100 |
| 4,260,115 | 4/1981 | Hatanaka | 241/236 |
| 4,330,092 | 5/1982 | Roman | 241/232 |
| 4,411,391 | 10/1983 | Crane | 241/232 |
| 4,489,897 | 12/1984 | Turner et al. | 241/167 |
| 4,545,537 | 10/1985 | Kimura et al. | 241/36 |
| 4,562,971 | 1/1986 | Schwelling | 241/236 |
| 4,565,330 | 1/1986 | Katoh | 241/236 |
| 4,627,581 | 12/1986 | Holiman et al. | 241/167 |
| 4,688,730 | 8/1987 | Dahle | 241/166 |
| 4,690,340 | 9/1987 | Hatanaka | 241/236 |
| 4,691,871 | 9/1987 | Mochizuki | 241/166 |
| 4,693,428 | 9/1987 | Raterman et al. | 241/167 |
| 4,773,603 | 9/1988 | Schwelling | 241/167 |
| 4,809,916 | 3/1989 | Schwelling | 241/166 |
| 4,881,692 | 11/1989 | Goldhammer et al. | 241/167 |
| 4,889,291 | 12/1989 | Goldhammer et al. | 241/167 |
| 4,919,345 | 4/1990 | Burlington et al. | 241/36 |
| 4,936,517 | 6/1990 | Kammerer et al. | 241/101.2 |
| 5,071,080 | 12/1991 | Herbst et al. | 241/166 |
| 5,230,477 | 7/1993 | Strohmeyer | 241/166 |
| 5,261,614 | 11/1993 | Schwelling | 241/167 |
| 5,295,633 | 3/1994 | Kimbro et al. | 241/166 |
| 5,328,107 | 7/1994 | Tsai | 241/295 |
| 5,346,144 | 9/1994 | Stangenberg et al. | 241/100 |
| 5,375,782 | 12/1994 | Schwelling | 241/166 |
| 5,400,978 | 3/1995 | Strohmeyer | 241/166 |
| 5,409,171 | 4/1995 | Stangenberg et al. | 241/167 |
| 5,474,243 | 12/1995 | Schwelling | 241/166 |
| 5,511,732 | 4/1996 | Kroger et al. | 241/166 |

FOREIGN PATENT DOCUMENTS

| | | |
|---|---|---|
| 0 010 681 A1 | 5/1980 | European Pat. Off. . |
| 0 069 721 A2 | 1/1983 | European Pat. Off. . |
| 0 395 935 A2 | 11/1990 | European Pat. Off. . |
| 0 525 491 A1 | 2/1993 | European Pat. Off. . |
| 0 532 773 A1 | 3/1993 | European Pat. Off. . |
| 0 778 087 A1 | 6/1997 | European Pat. Off. . |
| 2 628 343 A1 | 9/1989 | France . |
| 30 01 507 A1 | 7/1981 | Germany . |
| 33 12 173 A1 | 10/1984 | Germany . |
| 36 31 363 A1 | 3/1988 | Germany . |
| 1 558 423 | 1/1980 | United Kingdom . |
| 1 569 375 | 6/1980 | United Kingdom . |
| 2 059 804 | 4/1981 | United Kingdom . |
| 2 096 017 | 10/1982 | United Kingdom . |
| 2 215 236 | 9/1989 | United Kingdom . |

*Primary Examiner*—Joseph J. Hail, III
*Assistant Examiner*—Dermott J. Cooke
*Attorney, Agent, or Firm*—Brinks Hofer Gilson & Lione

[57] ABSTRACT

A shredder has a cutting cylinder with a cutting shaft and a plurality of spaced-apart cutter disks mounted on the cutting shaft. The shredder also has an articulated top blocker rotatably mounted above the center axis of the cutting shaft.

6 Claims, 4 Drawing Sheets

TOP BLOCKER FOR A PAPER SHREDDER

BACKGROUND OF THE INVENTION

This invention pertains to the field of shredders. More specifically, the invention relates to an articulated top blocker for a paper shredder.

In order to destroy documents to preserve their confidentiality, shredders exist which cut the paper into narrow strips or chips. Typically, the cutting is achieved by a pair of cutting cylinders having a series of circular cutters arranged along the axis of a shaft. The cutters of one shaft are offset so that they pass between the cutters of the other shaft. In addition, the cutters may be either a straight-cut type, which produces narrow strips of paper, or a cross-cut type, which produces small paper chips.

During operation of a paper shredder, paper particles may begin to collect inside the shredder housing, especially in the area behind the cutting cylinders, eventually causing the shredder to lock up or jam. These potentially damaging particles have two common sources: (1) cut paper particles can be swept inside the shredder housing by the normal forward motion of the cutters; and (2) uncut or partially cut paper particles can be dragged inside the shredder housing when the motion of the cutters is reversed. Unless the paper particles trapped inside the shredder are allowed to escape, the shredder will continue to lock up or jam and not function properly.

One typical solution to this problem is to provide auxiliary strippers or blockers on top of the cutting shafts between adjacent cutters. Examples of paper shredders that use such strippers are disclosed in U.S. Pat. Nos. 5,375,782 and 5,474,243, both to Schwelling. In each of these references, Schwelling discloses a paper shredder having a pair of cutting rollers, a plurality of cutting disks arranged on each cutting roller, a plurality of strippers below or on the side of each cutting roller, and a plurality of auxiliary strippers on the top of each cutting roller between adjacent cutting disks. Both the strippers and the auxiliary strippers, however, are fixed in position by a pair of spaced-apart parallel rods. As a result, the strippers and the auxiliary strippers disclosed by Schwelling serve to trap paper particles that find their way into the shredder housing and behind the cutting disks.

Accordingly, it is an object of the present invention to provide a solution to the problem of paper particles collecting inside a shredder that allows trapped paper particles to escape during normal operation of the shredder in the forward direction, but also blocks the entry of paper particles during operation of the shredder in the reverse direction. In the present invention, a shredder is provided comprising a pair of cutting cylinders with cutting shafts and spaced-apart cutter disks mounted on the cutting shafts, and an articulated top blocker rotatably mounted above the center axis of each cutting shaft. The articulated top blocker has a base and at least one stripper extending outward from the base toward the cutting shaft between adjacent cutter disks.

As a result of the articulated top blocker's ability to rotate, the articulated top blocker allows paper particles trapped in the paper shredder to be evacuated during normal operation in the forward direction, while preventing accumulation of paper particles in the shredder during operation in the reverse direction. Consequently, the shredder of the present invention is an improvement over prior art shredders that prevents paper particles from collecting inside a shredder causing the shredder to lock up or jam.

SUMMARY OF THE INVENTION

The present invention provides a shredder comprising a cutting cylinder having a cutting shaft with a center axis, and a plurality of spaced-apart cutter disks mounted on the cutting shaft. The shredder also comprises an articulated top blocker rotatably mounted above the center axis of the cutting shaft.

DETAILED DESCRIPTION OF THE PREFERRED EMBODIMENTS

Figure 1:
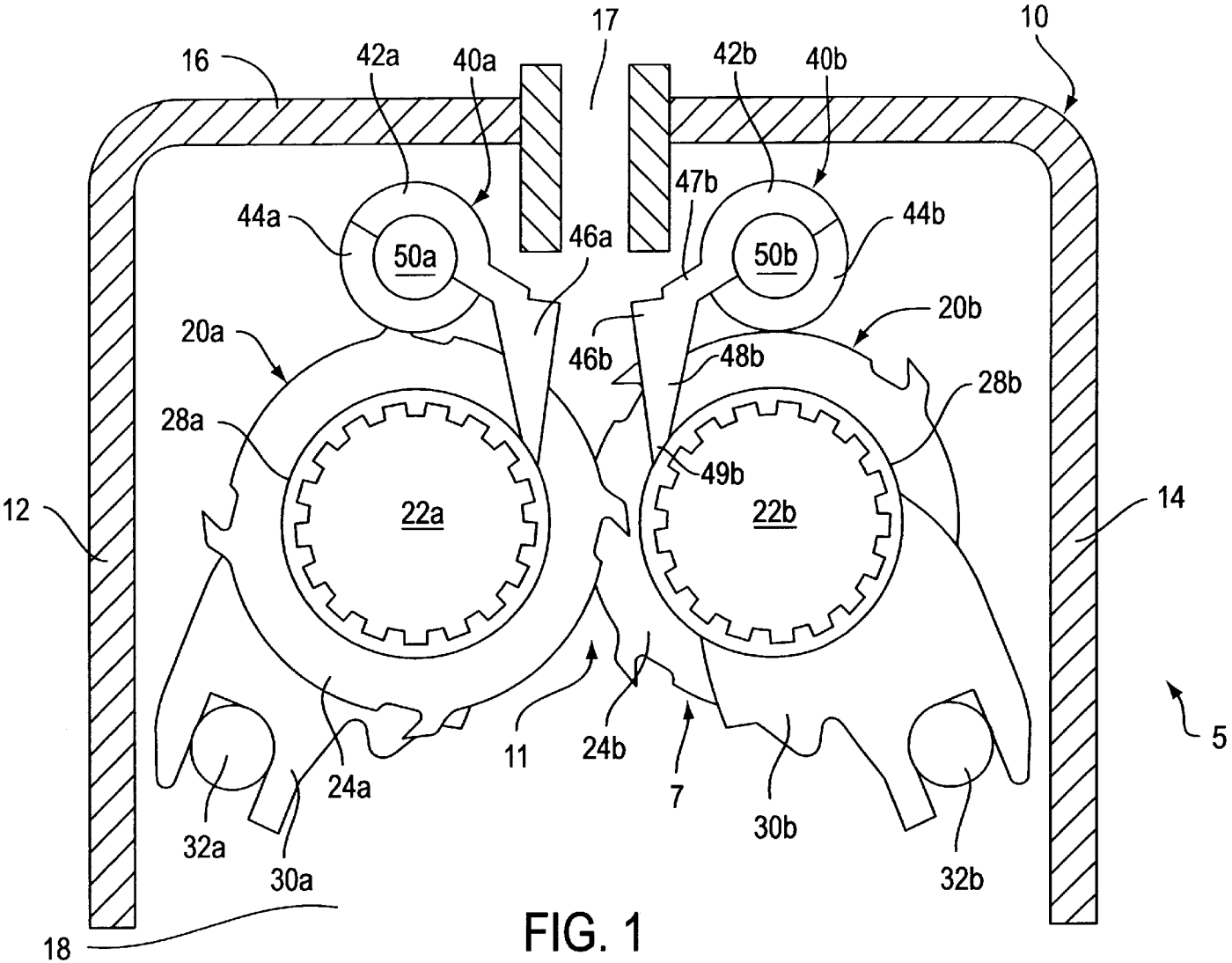
FIG. 1 is a side view of a paper shredder with a housing, a cutting mechanism, and a pair of opposing articulated top blockers of the present invention.
Figure 2:
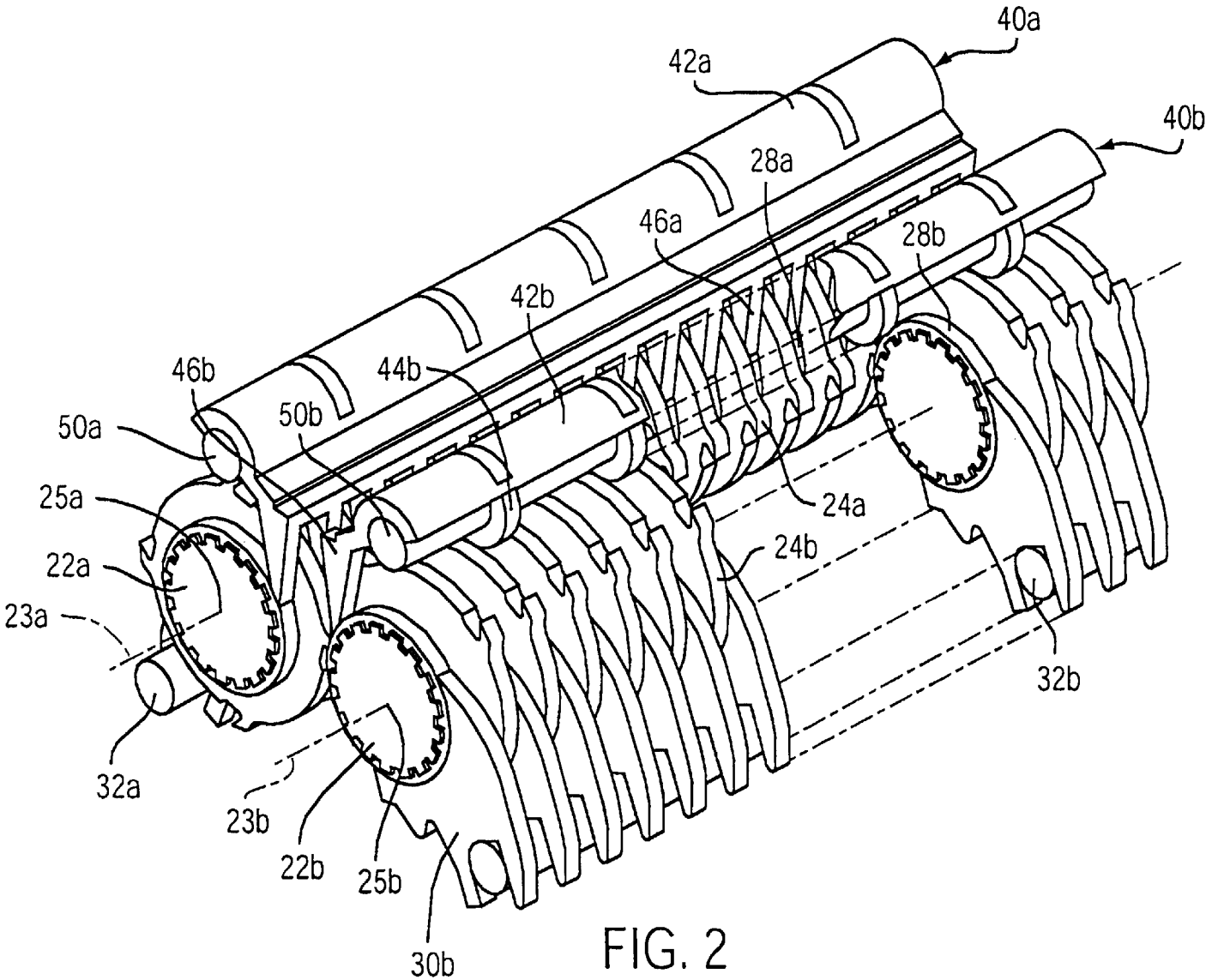
FIG. 2 is a perspective view of the cutting mechanism and articulated top blockers of FIG. 1, with a portion of the cutting mechanism and one of the articulated top blockers broken away to more clearly illustrate the cutting mechanism and the other articulated top blocker.

Turning now to the drawings, FIGS. 1–2 show a paper shredder 5 comprising a housing 10 with a first side wall 12, a second side wall 14, and a top wall 16. Preferably, the bottom 18 of the shredder is open, although a bottom wall with a discharge opening (not shown) may be used to cover the bottom of the shredder. The top wall 16 has a feed opening 17 through which the paper to be shredded is fed, and the open bottom 18 provides an exit for the shredded paper. The paper shredder 5 also has a cutting path 11 that runs between the feed opening 17 and the open bottom 18, as best shown in FIG. 1.

As also shown in FIGS. 1–2, the paper shredder also comprises a cutting mechanism 7 having a first cutting cylinder 20*a* and a second cylinder 20*b*. The first cutting cylinder 20*a* has a first cutting shaft 22*a* and a first set of spaced-apart cutter disks 24*a* arranged on the first cutting shaft 22*a*. Similarly, the second cutting cylinder 20*b* has a second cutting shaft 22*b* and a second set of spaced-apart cutter disks 24*b* arranged on the second cutting shaft 22*b*. Each cutting shaft 22*a*, 22*b* has an axis 23*a*, 23*b* (represented by a dashed line) through its center 25*a*, 25*b*, referred to hereinafter as a center axis. In addition, the cutter disks of the first cutting cylinder are sufficiently separated from each other to receive the cutter disks of the second cutting cylinder in an interleaving fashion.

Each cutting cylinder 20*a*, 20*b* may also have a plurality of spacers 28*a*, 28*b* positioned on the cutting shafts 22*a*, 22*b* next to and between each pair of adjacent cutter disks 24*a*, 24*b*. Preferably, the spacers are integral with at least one of the adjacent cutter disks. Alternatively, the spacers may be separate components that provide distance between each pair of adjacent cutter disks.

The paper shredder 5 also comprises a plurality of primary strippers 30*a*, 30*b* to prevent cut paper from winding around the cutting cylinders and clogging the shredder. As shown in FIGS. 1–2, each primary stripper is positioned near a spacer 28a, 28b on the cutting shafts 22*a*, 22*b* between the adjacent cutter disks 24*a*, 24*b*. Preferably, the primary strippers 30*a*, 30*b* are mounted on a rod 32*a*, 32*b* positioned off to the side of each cutting shaft 22*a*, 22*b*, parallel to and below its center axis 23*a*, 23*b*. It should be understood, however, that the rod, and thus the primary strippers, may be positioned in a number of different locations, including above or directly on the side of the center axis of each cutting shaft. More than one rod may also be used to support the primary strippers.

Alternatively, the primary strippers 30*a*, 30*b* may be integral with one or more walls of the housing 10. For instance, the primary strippers 30*a*, 30*b* may be integral with the side walls 12,14, respectively, of the housing 10. In addition, each primary stripper may be independent of, or connected with, one or more of the other primary strippers.

The paper shredder 5 also comprises a first articulated top blocker 40*a* associated with the first cutting cylinder 20*a* and a second articulated top blocker 40*b* associated with the second cutting cylinder 20*b*. The second articulated top blocker 40*b* is preferably, but not necessarily, identical to the first articulated top blocker 40*a*. Moreover, the articulated top blockers 40*a*, 40*b* are preferably made as an integral plastic component with a comb-like shape, although it is conceivable that the articulated top blockers may be made up of several parts, from a different material such as metal or rubber, and/or with a different shape.

Figure 3:
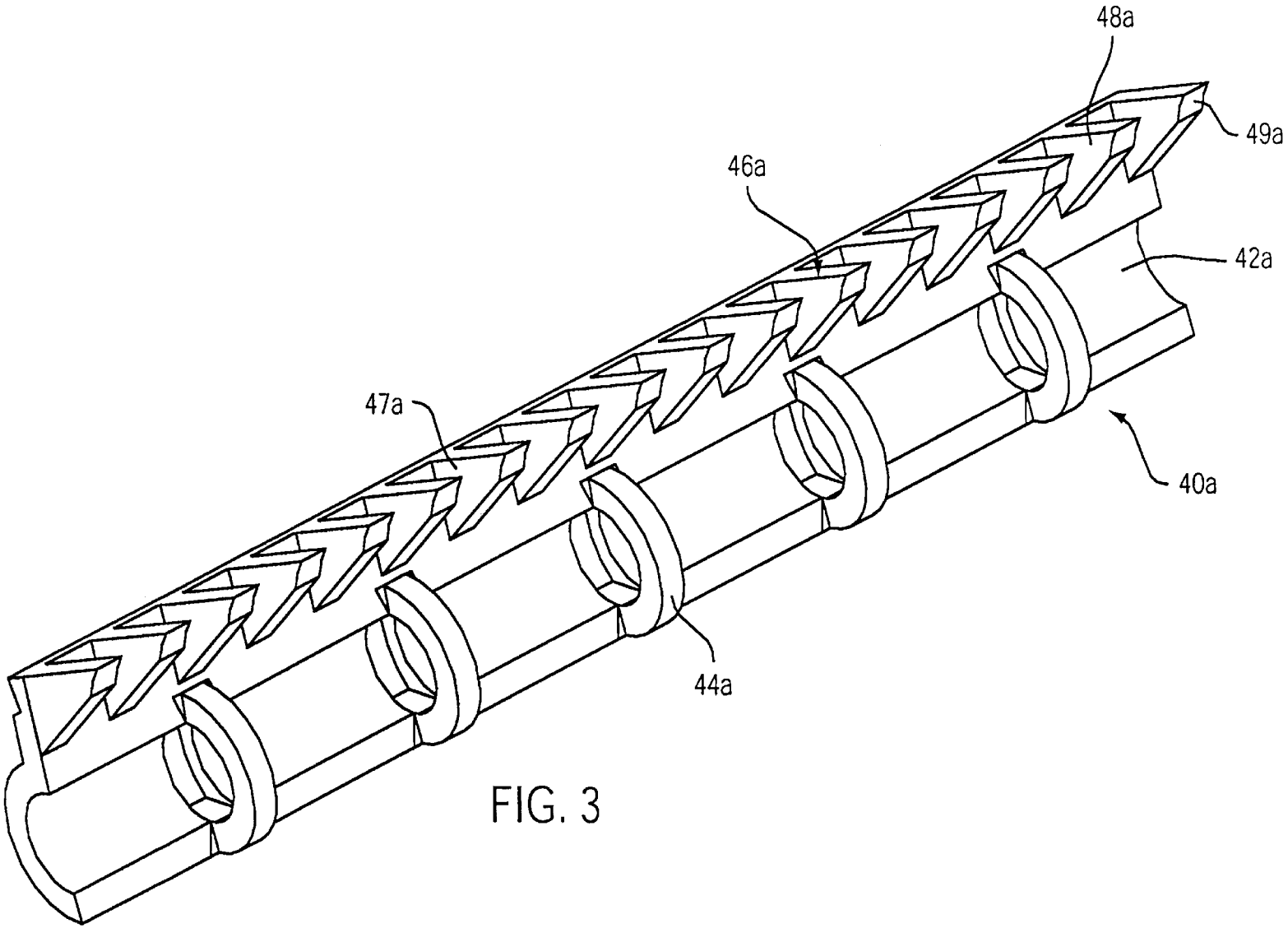
FIG. 3 is a bottom perspective view of one of the articulated top blockers of FIG. 1.

Each articulated top blocker 40*a*, 40*b* comprises a base 42*a*, 42*b* rotatably mounted on a support shaft 50*a*, 50*b*. As shown in FIGS. 1–3, the base may have one or more rings 44*a*, 44*b* for rotatably mounting the articulated top blocker on the support shaft. Although five rings are used in the most preferred embodiment of the present invention, any number of rings may be used to rotatably mount the base on its support shaft depending on consumer and manufacturing preferences. In addition, a single ring extending the entire length of the base (not shown) may be used to mount the base on the support shaft.

Each support shaft 50*a*, 50*b* is preferably positioned parallel to and directly above the center axis 23*a*, 23*b* of its respective cutting shaft 22*a*, 22*b*. It is to be understood, however, that the support shaft, and thus the articulated top blocker rotatably mounted on the support shaft, may be positioned in a number of other suitable locations, including above, but offset from the center axis of the support shaft.

As shown in FIGS. 1–4, each articulated top blocker 40*a*, 40*b* also comprises at least one stripper 46*a*, 46*b* extending outward from the base 42*a*, 42*b* toward its respective cutting shaft 22*a*, 22*b*. Preferably, each articulated top blocker 40*a*, 40*b* has a plurality of strippers 46*a*, 46*b* that extend outward from its base 42*a*, 42*b* toward the spacers 28*a*, 28*b* on its respective cutting shaft 22*a*, 22*b* and between each pair of adjacent cutter disks 24*a*, 24*b*. Each stripper 46*a*, 46*b* has a base end 47*a*, 47*b* attached to, and most preferably, integral with, the base 42*a*, 42*b* and a terminal end 48*a*, 48*b* opposite the base end 47*a*, 47*b*. The terminal end of each stripper has a face 49*a*, 49*b* that is preferably curved to correspond to the outer circumference of its respective cutting shaft 22*a*, 22*b*. Preferably, but not necessarily, the strippers 46*a*, 46*b* are also tapered inward from their base ends to their terminal ends.

Although the strippers of the articulated top blocker may have any desirable thickness, they preferably have a thickness less than the space between each pair of cutter disks, as shown in FIG. 2. Alternatively, the strippers may have a thickness approximately equal to the space between each pair of cutter disks. For manufacturing reasons, these thicker strippers may also have a hollow center (not shown).

Figure 4B:
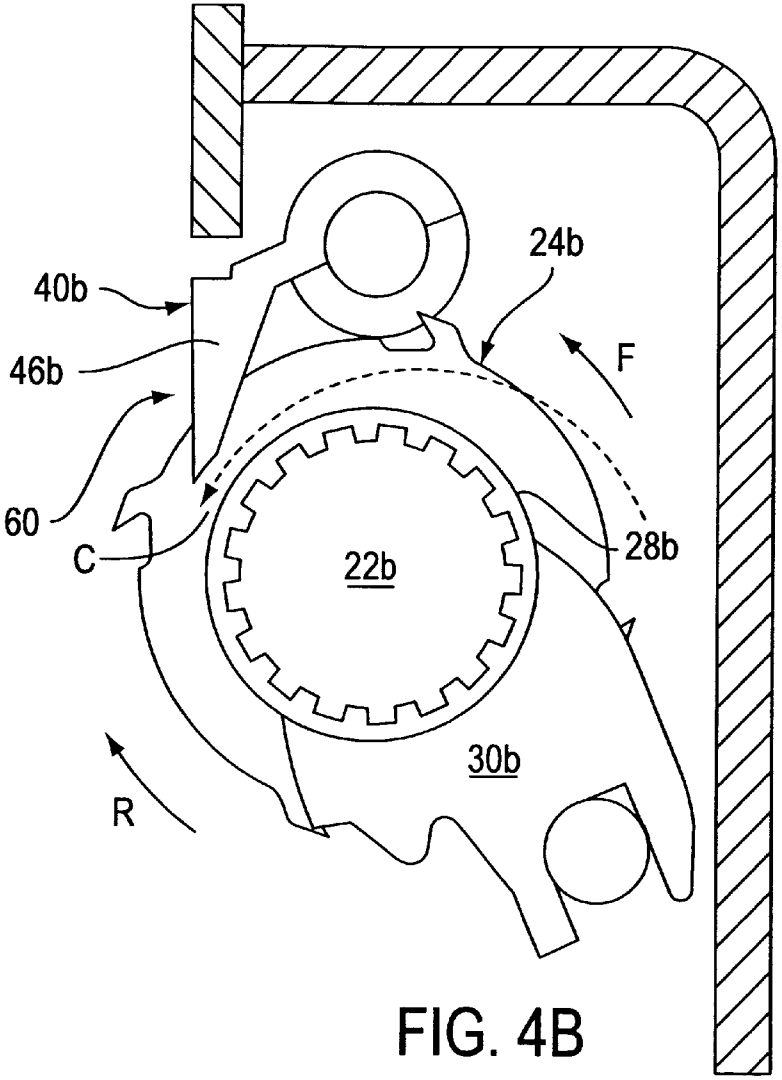
FIG. 4B is a side view of a part of the paper shredder of FIG. 1, with an articulated top blocker in a raised position.

The articulated top blockers of the present invention function in the following manner during operation of the shredder. During normal forward operation of the shredder, each articulated top blocker and its strippers are free to rotate to a raised position 60 away from their respective cutting shaft in a direction counter to the forward direction F of the cutter disks, as shown in FIG. 4B. The articulated top blockers and their strippers are pushed into this raised position 60 by pressure from paper particles trapped in the shredder during the normal forward operation of the shredder. As a result of this raised position, paper particles that are trapped in the shredder housing behind the cutting cylinders are able to escape through a channel C between the strippers of the articulated top blockers and the spacers of their respective cutting shafts. The evacuation of the trapped paper particles is represented by the dashed line shown in FIG. 4B.

Figure 4A:
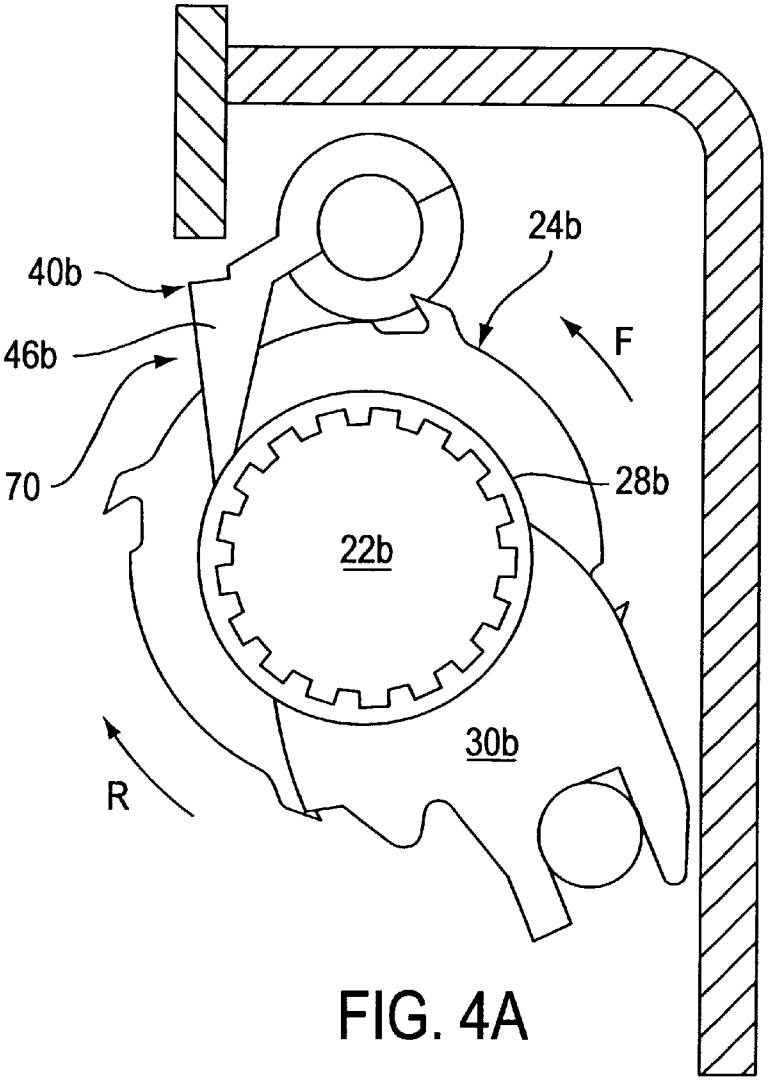
FIG. 4A is a side view of a part of the paper shredder of FIG. 1, with an articulated top blocker in a lowered position.

During operation of the shredder in a reverse direction R, the strippers of the articulated top blockers are pushed into a lowered position 70 against, or at least close to, the spacers of their respective cutting shafts, as shown in FIG. 4A, by pressure from partially cut paper or paper entering the shredder (not shown). In this lowered position 70, the strippers of the articulated top blockers strip paper off the spacers of the cutting shafts and prevent paper from entering the shredder housing behind the cutting cylinders.

The articulated top blocker of the present invention may be used in a variety of different paper shredding machines. Examples of paper shredders suitable for use with the articulated top blocker of the present invention are disclosed in U.S. Pat. Nos. 5,071,080, 5,295,633, and 5,511,732, all commonly assigned with the present application and specifically incorporated herein by reference.

In operation, the present invention can be used with particular advantage in a paper shredder for the office or the home. Since the articulated top blocker of the present invention is preferably an integral plastic component, it is relatively inexpensive to manufacture and easy to install in the shredder.

It should be understood that a wide range of changes and modifications can be made to the embodiments of the articulated top blocker and paper shredder described above. For instance, the support shaft for the articulated top blocker may be a separate component or may be integral with the housing. In addition, the articulated top blocker and/or the primary strippers may be positioned in different locations within the shredder housing than set forth above. Also, the housing illustrated in FIG. 2, may be a sub-housing, i.e. only a part of a larger housing. It is therefore intended that the foregoing description illustrates rather than limits this invention, and that it is the following claims, including all equivalents, which define this invention.

What is claimed is:

1. In a paper shredder having a cutting mechanism that includes a first cutting cylinder with plurality of spaced-apart cutter disks and a second cutting cylinder with a plurality of spaced-apart cutter disks, the cutting cylinders positioned to define a cutting path, the improvement comprising:

a. a first support shaft located above the first cutting cylinder and a second support shaft located above the second cutting cylinder;

b. a first top blocker rotatable about the first support shaft, the blocker having at least one stripper extending into a space between two cutter disks on the first cutting cylinder, wherein the at least one stripper moves from a first position adjacent the first cutting cylinder shaft to a second variable position toward the cutting path and away from the first cutting cylinder shaft; and c. a second top blocker rotatable about the second support shaft, the blocker having at least one stripper extending into a space between two cutter disks on the second cutting cylinder, wherein the at least one stripper moves from a first position adjacent the second cutting cylinder shaft to a second variable position toward the cutting path and away from the second cutting cylinder shaft.

2. The shredder of claim 1 wherein the first support shaft is stationary.

3. The shredder of claim 2 wherein the second support shaft is stationary.

4. The shredder of claim 1 wherein the first top blocker has a plurality of strippers with each stripper extending between each spaced-apart disk on the first cutting cylinder.

5. The shredder of claim 1 wherein the second top blocker has a plurality of strippers with each stripper extending between each spaced-apart disk on the second cutting cylinder.

6. The shredder of claim 1 wherein the cutting cylinders may alternately be rotated in a forward or a reverse direction.

* * * * *